United States Patent [19]

Heyman

[11] Patent Number: 4,473,008

[45] Date of Patent: Sep. 25, 1984

[54] METHOD FOR INTAGLIO PRINTING AND SELECTIVELY ALTERABLE INKING PLATE THEREFOR

[75] Inventor: Philip M. Heyman, Robbinsville, N.J.

[73] Assignee: RCA Corporation, New York, N.Y.

[21] Appl. No.: 534,103

[22] Filed: Sep. 20, 1983

[51] Int. Cl.[3] ..... B41M 1/10; B41N 1/00

[52] U.S. Cl. ..... 101/170; 101/109; 101/150; 101/163; 101/395

[58] Field of Search ..... 101/150, 151, 170, 163–166, 101/158–162, 395, 109, 66, 372, 373, 93.04; 400/125.1

[56] References Cited

U.S. PATENT DOCUMENTS

| | | | |
|---|---|---|---|
| 2,143,243 | 1/1939 | Hirschman et al. | 101/372 |
| 3,009,415 | 11/1961 | Harvey | 101/150 X |
| 3,099,711 | 7/1963 | Foley et al. | 400/125.1 X |
| 3,209,681 | 10/1965 | Sanborn | 400/125.1 X |
| 3,633,502 | 1/1972 | Schwandt | 101/150 |
| 4,060,031 | 11/1977 | Philipp | 101/163 |
| 4,209,551 | 6/1980 | Masaki et al. | 427/68 |
| 4,327,283 | 4/1982 | Heyman et al. | 235/487 |
| 4,374,451 | 2/1983 | Miller | 445/22 |
| 4,403,547 | 9/1983 | Forberger | 101/150 X |
| 4,403,548 | 9/1983 | Faller | 101/372 |

*Primary Examiner*—Clifford D. Crowder

*Attorney, Agent, or Firm*—E. M. Whitacre; D. H. Irlbeck; L. Greenspan

[57] ABSTRACT

In an intaglio printing method, the steps of providing a novel intaglio inking plate having a surface and means for producing different prescribed patterns of shallow depressions therein, producing a first prescribed pattern of depressions in said surface, filling said depressions with ink, transferring ink from the pattern of filled depressions to a transfer surface, altering the surface to provide a second pattern of shallow depressions therein and then repeating the step of filling the depressions with ink and transferring an ink pattern to a transfer surface.

9 Claims, 5 Drawing Figures

Fig. 3
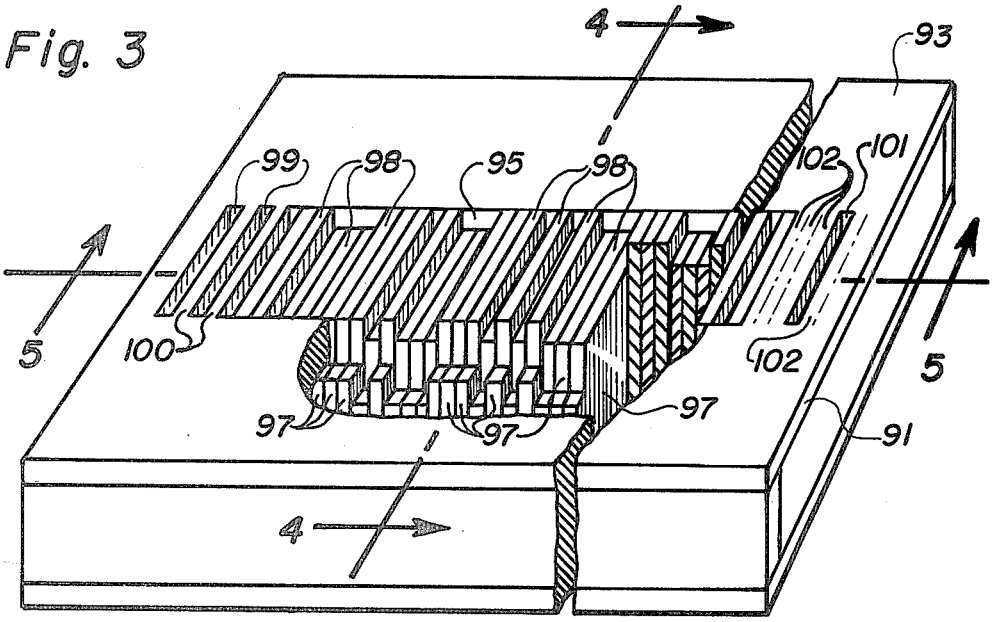
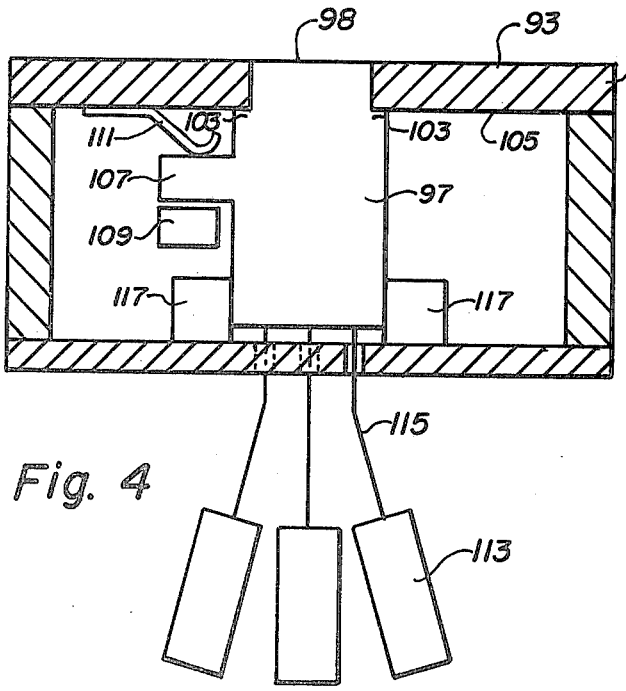
Fig. 4
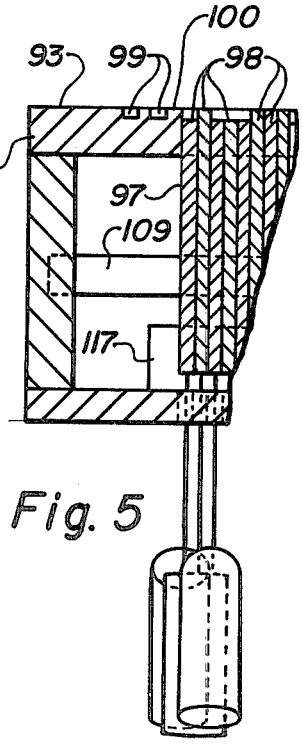
Fig. 5

METHOD FOR INTAGLIO PRINTING AND SELECTIVELY ALTERABLE INKING PLATE THEREFOR

BACKGROUND OF THE INVENTION

This invention relates to a novel method for intaglio printing and to a novel inking plate therefor. In the novel method, which is particularly useful for printing changeable markings, such as bar-coded markings representing serial numbers, on nonabsorbent surfaces, the depressed or intaglio areas of the inking plate can be changed on demand.

There are several printing machines on the market today that are able to print serial markings, such as serial bar-code markings, on paper or other soft absorbent materials. The techniques employed by these printers usually require building the marking out of a series of dots or bars in a sequential fashion. These machines are currently not capable of printing on hard, nonporous, irregular surfaces because of the unyielding nature of the printing elements and/or the slow drying nature of the ink.

In a prior offset pad printer, such as the unit described in U.S. Pat. No. 4,060,031 to W. Philipp, a very compliant printing pad transfers an ink pattern from etched shallow depressions in an intaglio inking plate to the receiving surface to be printed. Typically, the depressions in the inking plate are made by a photoengraving technique so that areas on the inking plate that have been etched correspond to the inked parts of the printed marking. In the full cycle, ink is dragged out of an adjacent reservoir and distributed over the inking plate surface to fill the depressions. Then, a doctor blade removes the excess ink and returns it to the reservoir so that the area around the depressions to be transferred is clean and ink fills the depressions. The pad then contacts the inking plate, thus picking up the pattern of ink from the depressions and carries the pattern to the receiving surface already prepared to accept the ink. In the next cycle, ink is again distributed over the plate surface to refill the depressions in the inking plate so that the process can be repeated.

The prior offset pad printer is effective to print fixed, and sometimes complicated, patterns on hard, nonplanar, irregular surfaces of nonabsorbent materials. The novel method disclosed herein can convert the prior intaglio printing method and inking plate to be capable of printing different markings, instead of the same fixed markings, on any surface, but particularly on hard, irregular surfaces of nonabsorbent materials.

SUMMARY OF THE INVENTION

The novel method, as in prior methods for intaglio printing, comprises providing an intaglio inking plate having a pattern of shallow depressions in a surface thereof, filling the depressions with ink, and then transferring ink from the pattern of filled depressions to a transfer surface or pad. Subsequently, the ink pattern is transferred from the pad to a receiving surface. Unlike prior methods, the pattern of shallow depressions in the inking plate may be changed after each transfer. Thus, each ink pattern transferred may be different from the preceding ink pattern and the succeeding ink pattern transferred from the inking plate.

The method employs a novel inking plate having means for producing different prescribed patterns of depressions therein. In one form, the bottoms of at least some of the depressions are movable on demand between the level of the plate surface and a prescribed shallow distance below that surface. Selected ones of the movable bottoms are positioned at the prescribed shallow distance, and the remainder of the movable bottoms are positioned flush with the plate surface. In a preferred form, the inking plate comprises a body having a plate surface with a rectangular aperture therein, and a stack of flat, platelike bars of rectangular cross-section that is so positioned in the aperture that the ends of the bars completely fill the aperture. Each bar is separately movable, as with a spring and solenoid combination, between the two mentioned positions.

BRIEF DESCRIPTION OF THE DRAWINGS

FIG. 3 is a partially-broken-away, isometric view of the inking plate used in the apparatus shown in FIGS. 1 and 2.

FIG. 4 is a partially-schematic sectional view of the inking plate shown in FIG. 3 viewed along section line 4—4.

FIG. 5 is a partially-schematic fragmentary sectional view of the inking plate shown in FIG. 3 viewed along section line 5—5.

DETAILED DESCRIPTION OF THE PREFERRED EMBODIMENTS

Figure 1:
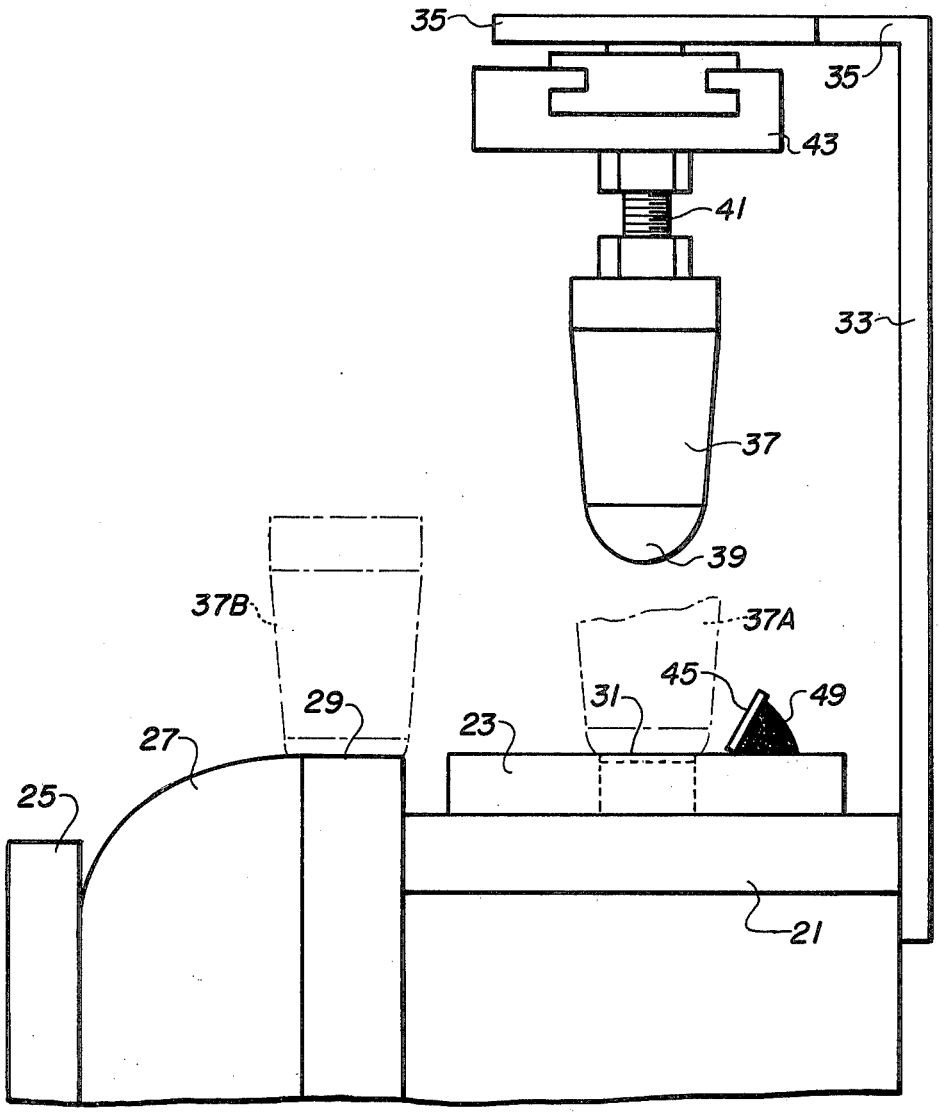
FIG. 1 is an elevational view of a first apparatus for practicing the novel method.

The steps in the novel method are exemplified below with reference to FIGS. 1 to 5 by the forming and transfer of a bar-code marking from an intaglio printing plate to the sidewall of a glass faceplate panel for a color television picture tube. Such prior-art bar-code markings are described, for example, in U.S. Pat. No. 4,327,283 to P. M. Heyman et al. and U.S. Pat. No. 4,374,451 to W. R. Miller. Suitable pad printing apparatus, except as noted below, is described in U.S. Pat. No. 4,060,031 to W. Philipp. However, other markings, both coded and uncoded, may be formed and transferred by the novel method and inking plate.

The simplified first apparatus shown in FIG. 1 comprises a table 21 on which is mounted a novel intaglio inking plate 23 (described in detail below) and a panel clamp 25 for holding a panel 27 in position against the table 21 with the sidewall surface 29 to be printed on facing upwards. The plate 23 has a plurality of depressions 31, each about 0.025 to 0.125 mm (1 to 5 mils) deep, whose shapes are directly related to the pattern to be printed.

A post 33 extends upwards from the table 21 to an outwardly-extending arm 35, which supports the transfer assembly over the table 21. The transfer assembly includes a resilient pad 37 made, for example, of a silicone polymer, having an appropriately-shaped pad transfer surface 39, and a pad support 41, which is attached to a common support 43. The common support 43 is connected to the arm 35 through a vertical moving means (not shown) for moving the transfer assembly vertically up or down, and a horizontal moving means (not shown) for moving the transfer assembly horizontally to positions over the inking plate 23 or over the receiving sidewall surface 29 to be printed.

The first apparatus is operated as follows. Starting from the positions shown in FIG. 1, the faceplate panel 27 is positioned fixedly in place by the clamp 25. The depressions in the inking plate 23 are adjusted as described below. A rake 45 is operated horizontally to pull a quantity of printing medium (called "ink" herein) 49 from a reservoir (not shown) across the surface of the inking plate 23, filling the depressions 31. A doctor blade, firmly pressed against the inking plate, then wipes across the plate in the reverse direction making the printing medium in the depressions level with the surface of the plate 23, cleaning the surface of the plate 23 of ink, and returning the excess ink to the reservoir. Next, the transfer assembly is lowered until the pad surface 39 presses on the plate surface 23, as shown by the first phantom lines 37A, and ink in the depressions 31 is picked up by the pad surface 39. Then, the assembly is raised back to the position shown in FIG. 1 with the desired pattern of ink on the pad surface 39. Next, the assembly is moved horizontally to a position over the receiving surface 29 to be printed. Then, the assembly is lowered until the pad surface 39 contacts and presses on the panel receiving surface 29 as shown by the second phantom lines 37B. In this position, the ink pattern on the pad surface 39 wets the receiving surface 29. Then the assembly is retracted upward and then back to the position shown in FIG. 1. During the initial portion of this last retraction, the ink pattern substantially entirely releases from the pad surface 39 and remains on the receiving surface 29. After the pad 37 has returned to its initial position, shown by solid lines in FIG. 1, the panel 27 is removed, another panel is clamped in its place and the apparatus is ready for another cycle.

The second apparatus shown in FIG. 2 comprises a first table 51 on which is mounted a novel intaglio inking plate 53 (described in detail below) and a second table 55 for holding a panel 57 in position with the sidewall surface 59 to be printed on facing sidewards toward the inking plate 51. The inking plate 51 may be the same plate 23 as is shown in FIG. 1, or it may be a different inking plate.

A frame 61 extends upwards from, and cantilevers over, the first table 51, supporting the transfer assembly over the first table 51. The transfer assembly includes a resilient pad 63, made, for example, of silicone polymer, having a generally rectangular pad transfer surface 65 and a pad support 67. The pad support 67 is mounted on a first piston rod 69 that is operated from a first pneumatic cylinder 71, which is supported on a drum 73 having a hole therethrough that is offset from its axis of rotation and through which the first piston rod 69 extends. The drum 73 is supported from an axle 75 on pillow blocks 77 mounted on the frame 61. Attached to the axle 75 is a pinion 79, which is contacted by a rack 81, which is driven by a second piston rod and a second pneumatic cylinder (not shown). The second cylinder, through the rack 79 and pinion 81, can rotate the drum 73 through at least 90° to position the first piston rod 69 to move either vertically or horizontally.

On the table 51, abutting the far side of the inking plate 53 opposite the second table 55, is an ink well or reservoir 83. A doctor blade and rake 85, attached to a third piston rod 87 and third pneumatic cylinder 89, rests in the ink well 83.

The second apparatus is operated as follows, starting from the position shown in FIG. 2. The third cylinder is activated to move the third piston rod 87 and doctor blade and rake 85 horizontally across the inking plate 53 and back to the initial position, carrying a quantity of ink across the inking plate 53, thereby filling the depressions therein with ink on the way out and wiping the excess ink from the plate surface back to the ink well 83 on the way back. Then, the first cylinder 71 is activated to move the pad 63 downwards into contact with the inking plate 53 as shown by the first phantom lines 63A, and then upwards back to its initial position, carrying an ink pattern on its surface 65. Next, the second cylinder is activated to rotate the transfer assembly about 90° through the rack 81 and pinion 79, so that the pad 63 is in the position shown by the second phantom lines 63B, and the first piston rod 69 is adapted to move horizontally. With the transfer assembly in this position, the first cylinder 71 is activated to move the pad 63 with the ink pattern thereon from the second position 63B into contact with the receiving surface 59 of the panel 57 as shown by the third phantom lines 63C. The pad 63 is then drawn back to the second position 63B, leaving the ink pattern on the surface 59. The transfer assembly is then returned to its initial position ready to start another cycle after the panel 57 is removed and another panel is put in its place.

Figure 2:
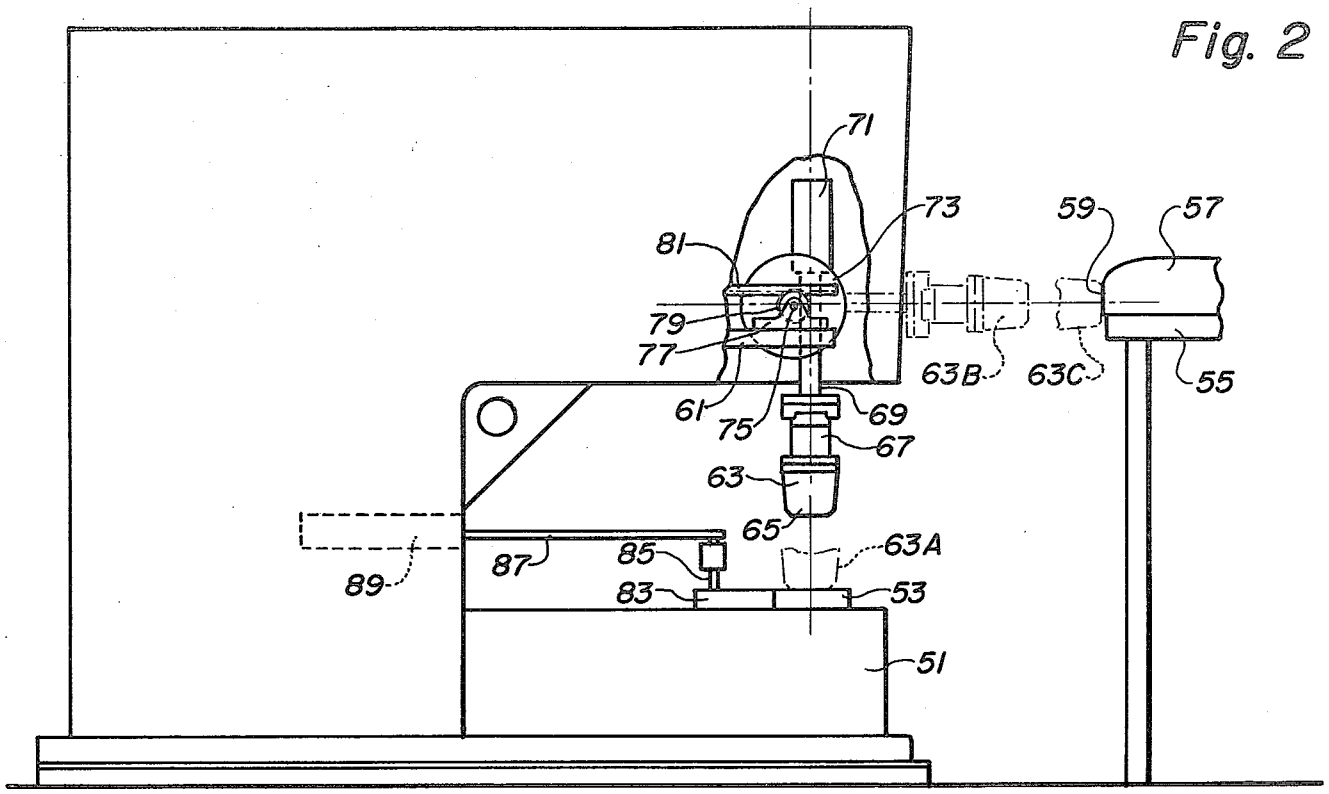
FIG. 2 is an elevational view of a second apparatus for practicing the novel method.

The apparatus shown in FIGS. 1 and 2 may be used for ordinary prior pad printing wherein the inking plate has fixed depressions eroded or engraved therein. In the novel method, that inking plate is replaced with a novel inking plate in which the depressions, or the arrangement of depressions, in the inking plate may be changed before and after each print transfer. To this end, the bottoms of at least some of the depressions in the inking plate are separately movable on demand between the level of the plate surface and a prescribed shallow distance below the plate surface. Except for the repositioning of the depression bottoms, the novel method is the same as in prior pad printing methods.

In one form, shown in FIGS. 3, 4 and 5, the novel inking plate, which is adapted for printing "white" bars on a "black" background, comprises a multitude of bars in combination with adjustable mechanisms for positioning the bars separately up or down to form a prescribed pattern of depressions for ink. When "black" is to be printed on a "white" background, for the same coded marking, the positions of depressions and non-depressions are reversed. The inking plate shown in FIG. 3 is designed to form a marking that is 12 digits long in the interleaved two-of-five bar code. Since each digit requires nine unit widths, 108 movable unit-width bars are required. In addition, four units are required at one end to form the "start" of the marking, and five units are required at the other end of the marking to indicate the "end" of the marking. The "start" and "stop" units can be movable, but since they do not change, they can be fixed; that is, etched or engraved in the inking surface. The optimum amount of movement by the bars depends on the nature of the ink being used, but is about 0.125 mm (5 mils).

Referring now to FIGS. 3, 4 and 5, the inking plate comprises a body 91 of metal having a surface 93 with a rectangular aperture 95 therein. The aperture 95 is blocked or closed by the flat ends 98 of one hundred eight flat, platelike bars 97, each one of which is separately movable between a position that is flush with the plate surface 93 and a shallow distance below the plate surface. In addition, there are several barlike grooves 99 etched into the plate surface 93 at opposite ends of the aperture 95 for use as fixed "start" and "stop" indicators. When printing "white" on a "black" background, there is provided, but not shown, an etched area at each end of the bar-code structure equal in width to at least 10 unit widths to act as quiet zones.

In FIG. 3, the "start" indicator is at the left of the aperture 95, and, reading from the left, there is, in unit widths, a groove 99, a space 100, a groove 99 and a space 100. The "stop" indicator is on the right of the aperture 95, and reading from the aperture 95, there are in unit widths, a space 102, a space 102, a space 102, a groove 101 and a space 102. In this example, the unit sizes of all of the spaces, grooves and bar ends are about 19 mm (750 mils) high and 0.6 mm (25 mils) wide.

The movable bars 97 are positioned to produce a coded number in the interleaved two-of-five code. Each bar 97 has a flat end with the same unit height and unit width. The bars are stacked side by side with their long major sides touching one another. To make a space, the end 98 of the movable bar 97 is positioned flush with the plate surface 93. To print an ink bar, the movable bar 97 is positioned so that its end 98 is a predetermined shallow distance below the plate surface 93.

A detail of a bar 97 and its associated structure shown in FIGS. 4 and 5. Each bar 97 is a flat, platelike body having a flat end 98 exposed through the aperture 95; a pair of shoulders 103 opposite the bottom side of the inking plate 91, which shoulders serve as stops for the flush position of the end 101; and a side arm 107, which serves as a stop for the depressed position of the end 98 when it bears against the block 109. A spring 111 attached to the underside of the body 91 bears against the side arm 107 urging the bar 97 into the depressed position against the block 109. A solenoid 113, connected by a linkage 115 to the bar 97, when energized, can overcome the pressure from the spring 111 and drive the bar 97 to the flush position. There are guides 117 for keeping the bars 97 within the prescribed boundaries of movement. In operation, either hardware or software logic can be used to convert numbers to the correct pattern of flush and depressed positions. These positions must be maintained while the depressions are being filled with ink, the excess ink is removed and the pattern of ink in the depressions is transferred to the pad. Then, a new pattern of depressions can be produced with the novel inking plate.

There are other ways to design the mechanism to produce the same printing bar motions, such as solenoid-driven cams or wedges or electrically-operated clutches that connect the appropriate cams to a small number of shafts which rotate through 90° of 180°. The major design problem is the same in all cases; that is, individual control over 108 bars on close centers (e.g., 25-mil centers typical for a twelve digit interleaved 2-of-5 bar code marking required to fit into a 3 ½-inch length). For example, if solenoids are used, they have to be fanned out, as they are in dot-matrix impact printers, to provide sufficient mounting room. The solenoid motion, which is of the order of several mils, may be transferred to the printing bar by a wire running through a tube.

Generally, any ink usable in a pad-printing process can be used in the novel method. Generally, such inks comprise a colorant or pigment and a binder in a nonaqueous medium. Inks which include an organic solvent may be used but are not preferred for transfers to nonabsorbent surfaces, such as a glass surface, because the transferred pattern requires drying by evaporation and may need to be baked to completely dry the transferred pattern. For transfers to nonabsorbent surfaces, it is preferred to use an ink that consists essentially of a polymer that is curable by ultraviolet (UV) radiation. Particulate pigment and/or particulate glass may be included in the ink. After transferring the pattern to the nonabsorbent surface, the pattern can be cured in less than 10 seconds to a solid nontacky form following exposure to a short flash of ultraviolet light. Some suitable UV-curable inks are disclosed in U.S. patent application Ser. No. 478,846 filed Mar. 25, 1983 by J. N. Bleacher.

The printing pads (37 and 63 respectively in FIGS. 1 and 2) are designed to pick up the desired pattern of ink from the inking plate and to release it substantially entirely to the receiving surface. To this end, the pad surface should have a relatively low adhesion for the ink of the pattern, and should have a weaker attraction for the pattern than does the receiving surface. One of several techniques can be employed to achieve this. The cycle can be adjusted to permit some evaporation of solvent from the pattern while it is on the pad. Or, a pad can be provided having a tacky surface which has a weaker attraction for the pattern than the receiving surface. Another way is to adjust the cycle to have a slow pickup at the inking plate and a rapid withdrawal of the pad from the receiving surface.

Besides tackiness of the surface, the pad may be modified in size, shape, softness and porosity. For transfers of UV-curable ink patterns, a softness is preferred, which results in optimum pressure distribution across the pad surface on contact with another surface. Also, when the pattern is striplike, as with a 12-digit bar-code marking, it is preferred to employ a rectangularly-shaped pad. In some cases, a pad that is slightly porous and impregnated with silicone oil may be preferred.

What is claimed is:

1. In a method for intaglio printing, the steps of

A. providing an intaglio inking plate having a surface and means for producing different prescribed patterns of shallow depressions in said surface, said inking plate comprising a body having a plate surface with an aperture therein, a plurality of separately-movable bars in said aperture, each bar having a flat end, each flat end being movable between a first position flush with said plate surface and a second position depressed a small distance below said plate surface, the combination of all of said ends of said bars entirely blocking said aperture with substantially no spaces therebetween, B. producing a first prescribed pattern of depressions in said surface, including positioning a selected combination of said bars with the ends thereof in said first position flush with said surface and the ends of the remaining bars in said second position depressed from said surface, C. filling said depressions with ink, D. transferring an ink pattern from said pattern of filled depressions to a transfer surface, E. altering said surface to provide a second prescribed pattern of shallow depressions therein including positioning a different selected combination of said bars with the ends thereof in said first position flush with said surface and the ends of the remaining bars in said second position depressed from said surface and then F. repeating steps C and D.

2. The method defined in claim 1 wherein said plate aperture is substantially rectangular, each of said flat ends has a substantially-rectangular cross section with two substantially-parallel major sides, and all of said bars are arranged with all of said major sides substantially parallel to one another.

3. The method defined in claim 1 wherein said inking plate comprises a body having a major surface with a rectangular aperture through said plate, a multiplicity of separately-movable flat bars of rectangular cross-section filling said aperture, the ends of said bars all being of equal height, and equal unit width, the ends of said bars being movable between a first position flush with said surface and a second position depressed a shallow distance below said surface.

4. The method defined in claim 1 including repeating steps E and F a multiplicity of times, with a different combination of selected ones of said bars in said depressed positions for each successive time.

5. An intaglio inking plate comprising a body having a major surface with an aperture therein, a plurality of separately-movable bars in said aperture, each bar having a flat end that is movable between a first position flush with said major surface and a second position depressed a small distance below said major surface, the ends of said bars entirely blocking said aperture with substantially no spaces therebetween.

6. The inking plate defined in claim 5 wherein each of said bars has two substantially-parallel opposed major sides and said bars are stacked on said major sides.

7. The inking plate defined in claim 6 wherein said bars have subsantially-equal thicknesses and widths and are located in a rectangular aperture in said body.

8. In combination, the inking plate defined in claim 5 and means for separately moving each of said bars between said flush position and said depressed position.

9. The combination defined in claim 8 wherein said moving means comprises, for each bar, a spring urging said bar to one of said positions and a solenoid which when excited urges said bar to the other of said positions against the urging of said spring.

* * * * *